US007712243B2

(12) United States Patent
Morando

(10) Patent No.: US 7,712,243 B2
(45) Date of Patent: May 11, 2010

(54) APPARATUS FOR FIREARM MAINTENANCE

(76) Inventor: Gregory Morando, 189 Boulton Ct., Madison, AL (US) 35756

( * ) Notice: Subject to any disclaimer, the term of this patent is extended or adjusted under 35 U.S.C. 154(b) by 0 days.

(21) Appl. No.: 12/342,119

(22) Filed: Dec. 23, 2008

(65) Prior Publication Data

US 2009/0235569 A1 Sep. 24, 2009

Related U.S. Application Data

(60) Provisional application No. 61/038,115, filed on Mar. 20, 2008.

(51) Int. Cl.
*F41C 27/00* (2006.01)

(52) U.S. Cl. ..... 42/108

(58) Field of Classification Search ..... 42/107, 42/108

See application file for complete search history.

(56) References Cited

U.S. PATENT DOCUMENTS 1,481,517 A * 1/1924 Kurz ..... 81/3.8
2,033,834 A * 3/1936 Kirsch ..... 160/173 R
2,549,395 A * 4/1951 Short, Sr. ..... 296/97.5
4,090,420 A * 5/1978 Insolio ..... 225/93
4,387,525 A 6/1983 Musgrove
5,261,136 A 11/1993 Hall
5,657,674 A * 8/1997 Burnett ..... 81/22
5,906,065 A 5/1999 Pearce
6,173,519 B1 1/2001 Garrett
7,073,285 B2 7/2006 Obong
2003/0140461 A1 * 7/2003 Wilcock ..... 24/191

* cited by examiner

*Primary Examiner*—Stephen M Johnson
(74) *Attorney, Agent, or Firm*—Bradley Arant Boult Cummings LLP; Jeremy A. Smith; Frank M. Caprio

(57) ABSTRACT

The present disclosure teaches an apparatus for removing a firearm magazine's floorplate comprising a substantially elliptically shaped element comprising an open end, a top surface, a bottom surface and an inner surface, a notch located in the upper surface of the element, a slit on the open end opposite the notch and a plurality of projections located on the inner surface. Methods of using the apparatus are also disclosed.

9 Claims, 3 Drawing Sheets

APPARATUS FOR FIREARM MAINTENANCE

CROSS-REFERENCE TO RELATED APPLICATIONS

This application claims priority from U.S. Provisional Application No. 61/038,115, filed Mar. 20, 2008 entitled "Apparatus for Firearm Maintenance."

FIELD OF THE INVENTION

The disclosed apparatus relates to the proper maintenance of firearms. More particularly, the invention discloses a tool useful for removing the floorplate of a firearm's magazine.

BACKGROUND ART

A magazine also called a clip is an ammunition storage and feeding device within or attached to a firearm. Magazines may be integral to the firearm (fixed) or removable (detachable). The cartridges in the magazine are loaded or fed into the firearm's chamber either automatically or manually depending on the firearm, but almost always by a spring. The most common type of magazine is the detachable "box" type.

Firearms must be clean to function reliably and safely. One common area of firearm malfunction, especially in the field (i.e., hunting, a law enforcement operation or military combat), is dirt or debris inside the magazine which interferes with the proper loading of ammunition from the magazine to the chamber. Accordingly, it is desirable to have a tool that allows quick and easy access to the magazine's magazine tube, via removal of the magazine's floorplate, so that the magazine tube and spring can be cleaned to insure proper operation.

Some firearms, such as some Glock® pistols, have magazines that are very difficult to disassemble and clean. One possible method of removing a magazine's floorplate is known in the prior art. The method relies upon a pliers-like device to remove the floorplate. The pliers' beaks must be held in place, while the handles are at a distance from the magazine, making it difficult to apply pressure on the locking tabs, maintain control of the magazine and manipulate the release of the floorplate with the other hand. Consequently, a device that provides easy application of force on the locking tabs while removing the floorplate is desirable. The current invention allows the user to secure the magazine and apply force to the magazine releasing the locking tabs in a manner which is easily accomplished with one hand, allowing the other hand to remove the floorplate and preventing damage to the magazine.

BRIEF DESCRIPTION OF DRAWINGS

It should be noted that identical features in different drawings are shown with the same reference numeral.

DETAILED DESCRIPTION

Figure 1:
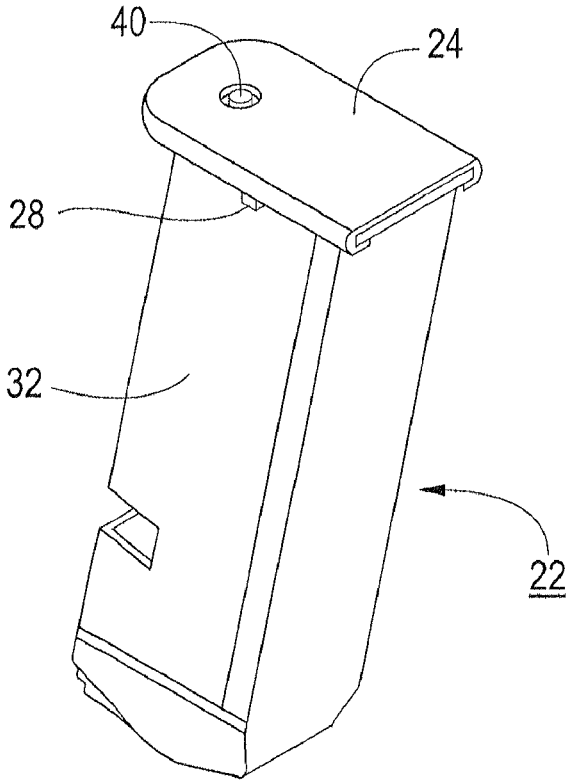
FIG. 1 shows a perspective view of a firearm magazine.

The current invention discloses a tool used for removing a floorplate of a firearm's magazine. The tool allows its user to apply sufficient force to the magazine's side walls to disengage locking tabs on the magazine from retaining cut-outs on the floorplate and to remove the floorplate.

FIGS. 1, 2, 6 and 7 show a firearm magazine 22 used to store ammunition (not shown). The ammunition is stored in a magazine tube 26 and is fed by a spring-loaded mechanism (not shown) into the firearm's chamber (not shown). To assure safe and dependable operation of the firearm, the magazine 22 must be cleaned from time-to-time. Many magazines 22 have a floorplate 24, located on the bottom of the magazine 22, which must be removed to clean the magazine 22. Some floorplates 24 employ locking tabs 28 located on the magazine 22 (often the locking tabs 28 are located on opposite sides of the sidewalls 32) that fit into retaining cut outs 30*a* and 30*b* on the floorplate 24 locking the floorplate 24 into position thereby enclosing the lower end of the magazine tube 26. It is desirable to preserve the structural integrity, i.e., the "locking mechanism", by preserving the shape of the locking tabs 28 and the retaining cutouts 30*a* and 30*b* assuring a close fit between the floorplate 24 and the magazine 22. One method of preserving the integrity of the locking mechanism is to completely or nearly completely disengage the locking tabs 28 from the retaining cut-outs 30*a* and 30*b* before attempting to remove the floor plate 24.

Figure 2:
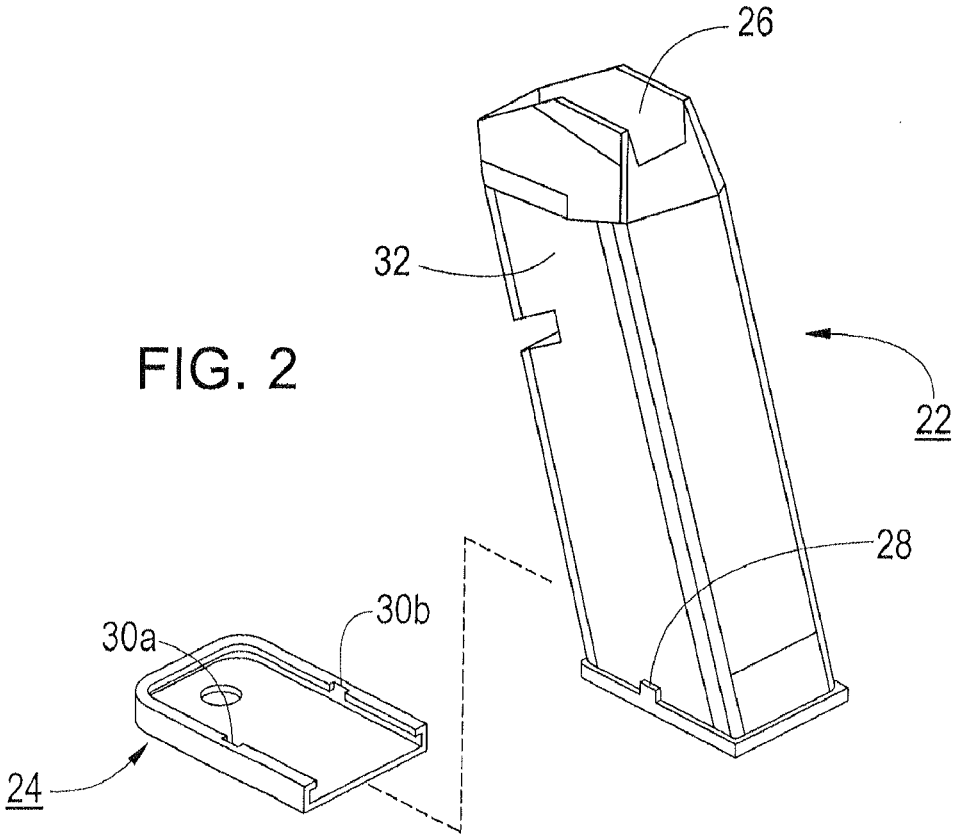
FIG. 2 shows a perspective view of a firearm magazine with the floorplate removed exposing the locking tabs on the magazine and the retaining cut outs on the floorplate.
Figure 3A:
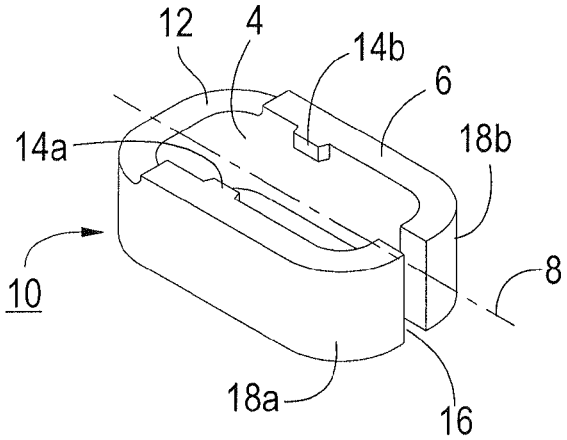
FIGS. 3*a* and 3*b* show a three quarter (¾) view of one embodiment of the tool disclosed herein.
Figure 3B:
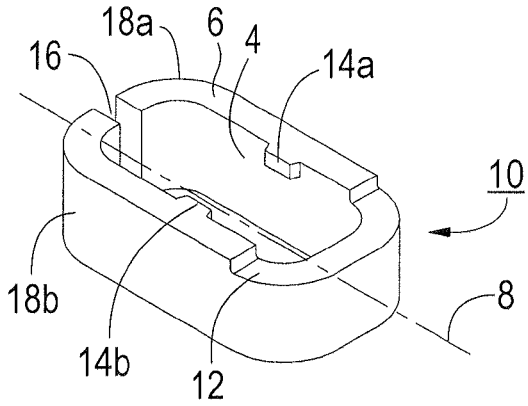
Figure 4:
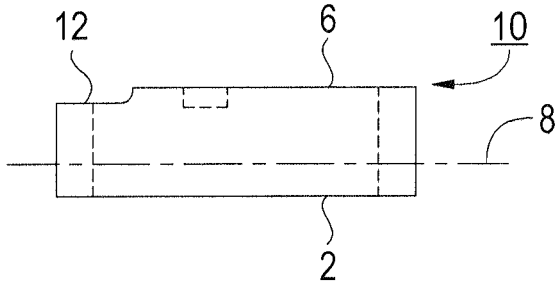
FIG. 4 shows a side view of one embodiment of the tool disclosed herein.

Generally, to remove the floorplate 24 from the magazine 22, one must apply sufficient force to the magazine's side walls 32 to depress the locking tabs 28 and disengage them from the retaining cut-outs 30*a* and 30*b*. Once the locking tabs 28 are disengaged, the floorplate 24 may be slid off the magazine 22 in a horizontal or nearly horizontal motion as depicted in FIG. 2. This particular embodiment shows the method of removing the floorplate from a "Generation I" magazine for the Glock® pistol. "Generation II" and "Generation III" Glock® magazines have a retaining pin which is part of the reinforcement plate which must be depressed with a punch or other similar instrument before depressing and disengaging the locking tabs. The present invention will work with any generation of the Glock® magazines.

One embodiment of the invention is depicted in FIGS. 2, 3*a*, 3*b*, 4, 5 and 7. The tool 10 has an upper surface 6, lower surface 2, an inner surface 4, an open-end having a slit 16, a long horizontal axis 8 and two (2) arms 18*a* and 18*b*. The slit 16 allows the user to squeeze the tools arms 18*a* and 18*b* together, but only to the point the arms 18*a* and 18*b* touch. This particular embodiment has a notch 12 located on the upper surface 6 of the tool 10 located opposite the open-end. The notch 12 allows for easy removal of the floorplate 24. The tool 10 has a plurality of projections 14*a* and 14*b* on its inner surface 4.

In this particular embodiment, the tool 10 is a rectangularly-shaped hollow ring made of a plastic, nylon or other polymer. The tool 10 may be made from a rigid or semi-rigid material (the "construction material") having the stiffness and strength to displace the locking tabs 28 from the floorplate's retaining cut-outs 30*a* and 30*b*, yet flexible enough (i) to allow the user to "squeeze" or apply pressure to the tool's arms 18*a* and 18*b* together creating the force necessary to use the tool 10 and (ii) allow the tool 10 to return to its original shape after each use. In one embodiment, the construction material is glass filled nylon. In one embodiment the glass filled nylon contains between about 0 to 20 percent glass. In another embodiment glass filled nylon contains between about 21 to 40 percent glass. In yet another embodiment, the glass filled nylon contains between about 41 to 60 percent glass. In yet another embodiment, the glass filled nylon contains over 60 percent glass. Other materials may be added to the construction material to yield the desired flexibility and stiffness. Accordingly, as one skilled in the art will realize, the tool 10 may be made from a variety of materials.

Further in this embodiment, the tool 10 has two (2) projections 14*a* and 14*b* on its inner-surface 4 and a slit 16 perpendicular to its long horizontal axis 8. In an alternate embodiment (not shown) the tool has four (4) projections on its inner surface. The slit 16 is located opposite the notch 12. In this embodiment, the tool 10 has measurements of about 2.5" long, about 1.25" wide and about 0.75" tall. Further, the slit 16 in this embodiment may be about 0.125" wide. However, the slit 16 may range from about 0.0625" to 0.250" wide. In an alternate embodiment the slit is not perpendicular to the long horizontal axis 8. These dimensions of the embodiment of the invention are designed to fit a magazine for a Glock® pistol with a caliber of either 9 mm, 0.40 S&W, or 0.357 Sig. For a Glock® pistol with a caliber of 10 mm, 0.45 ACP, or 0.45 GAP, the dimensions will be larger due to the larger diameter of this ammunition and the correspondingly larger width of the magazine 22. For magazines with a "single stack" configuration, the dimensions of the invention will be smaller due to the decreased width of the magazine 22. If the tool 10 is configured to receive magazines for different firearms, the tool 10 may have different dimensions as would be obvious to one skilled in the art.

Figure 5:
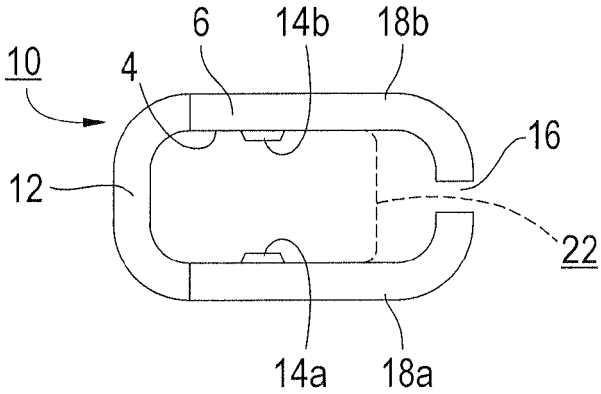
FIG. 5 shows a top view of one embodiment of the tool disclosed herein with the magazine (shown in dotted lines) inserted into the tool.
Figure 6:
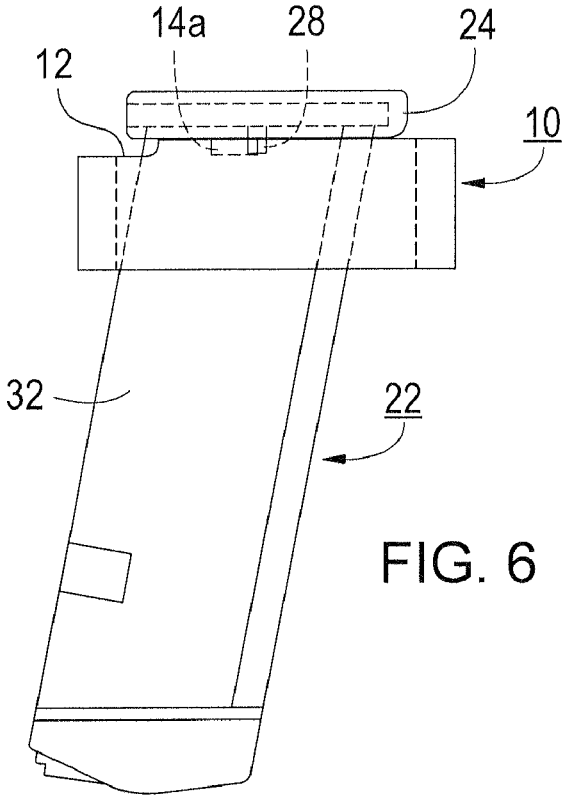
FIG. 6 shows a side view of a magazine inserted into one embodiment of the tool.
Figure 7:
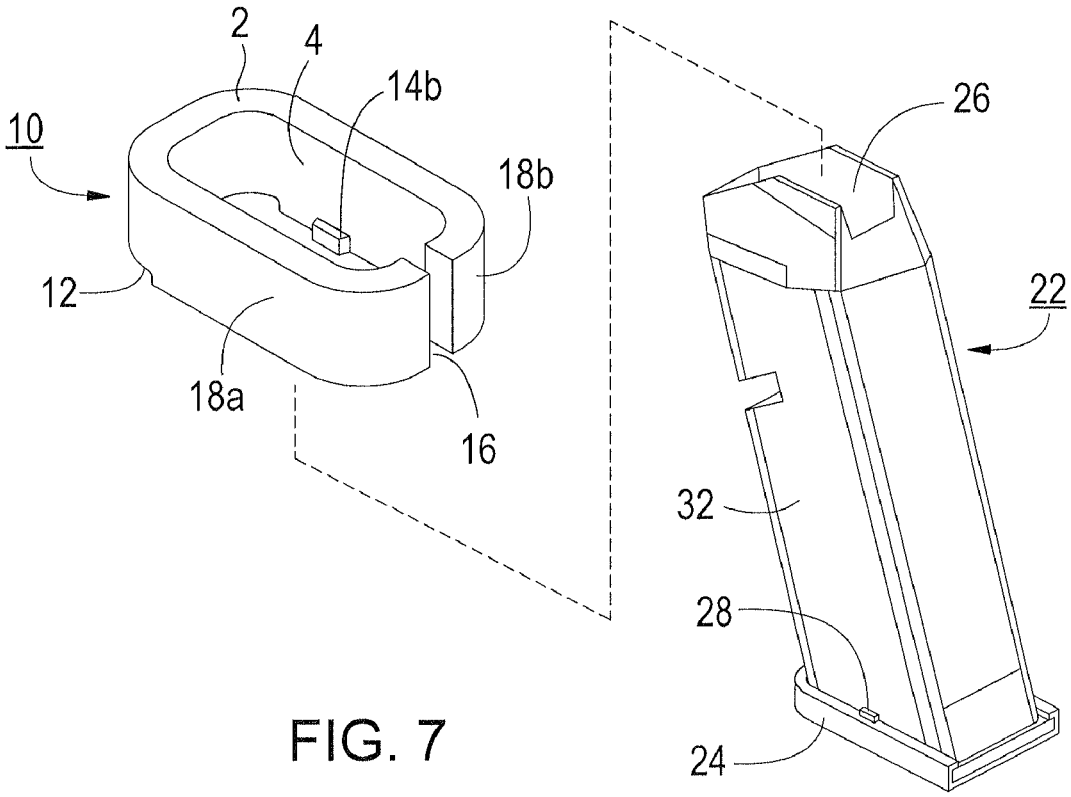
FIG. 7 shows one possible embodiment inserting the magazine into one embodiment of the tool.

FIGS. 5, 6 and 7 show one possible embodiment of using the tool 10. In this embodiment, the tool 10 is configured to receive or slide over a Glock® firearm's magazine 22. After sliding the tool 10 lengthwise, from top to bottom, along the magazine 22 until the tool 10 rests against the locking tabs 28, the user squeezes the tool's arms 18*a* and 18*b* together creating pressure points on the magazine's side walls 32. The projections 14*a* and 14*b* create pressure points immediately adjacent to the magazine's locking tabs 28, sufficient to disengage the locking tabs 28 from the floorplate's retaining cut-outs 30*a* and 30*b*. As shown in FIG. 7, after the locking tabs 28 are disengaged from the floorplate's retaining cut-outs 30*a* and 30*b*, the floorplate 24 is slid in a horizontal or nearly horizontal motion off of the magazine 22. Once the floorplate 24 is removed, the user can clean the inside the magazine tube 26 to remove debris and other materials which may interfere with the proper operation of the firearm.

To replace the floorplate 24 after cleaning, the user will again slide the tool 10 lengthwise, from top to bottom, along the magazine 22 and squeeze the arms 18*a* and 18*b* of the tool 10, applying pressure to the magazine's side walls 32, thereby allowing user to slide the floorplate 24 and corresponding retaining cut-outs 30*a* and 30*b* over the locking tabs 28 into a secure position.

Other embodiments of the present invention are possible. For example, some magazines 22 (such as Glock®'s second and third generation magazines) have additional attachment mechanisms attaching the floorplate 24 to the magazine 22. One such mechanism is a retaining pin 40 which must be released before the floorplate 24 may be removed. The present invention should be understood to assist the user in removing a floorplate 24 from any magazine 22 including without limitation the second and third generation Glock® magazines.

The current invention has several advantages. First, the tool 10 minimizes the wear on the magazine's locking tabs 28 and the floorplate's 24 retaining cut-outs 30*a* and 30*b* during disassembly (or assembly) by disengaging the locking tabs 28 from the retaining cut-outs 30*a* and 30*b*, allowing the floorplate 24 to be easily removed (or replaced) preserving the structural integrity of the retaining cut-outs 30*a* and 30*b* and the locking tabs 28. Further, using the tool 10, the magazine 22 may be disassembled (or assembled) without marring or scuffing the magazine 22. This is especially important when the tool 10 is used to remove the floorplate of a Glock® firearm's magazine as Glock® magazines are often made of polymers (i.e., composite materials) which may be marred or scuffed during assembly and disassembly. Additionally, the tool 10 limits the amount of force that can be applied to the magazine's side walls 32. By limiting the amount of force applied to the magazine's side walls 32 during disassembly or assembly, damage to the magazine's metal liner (not shown) may be avoided. Finally, the tool's 10 precise fit over the magazine 22 allows for easy disassembly, assembly and cleaning of the magazine 22 by one person.

While the invention has been described with respect to a limited number of embodiments, those skilled in the art, having benefit of this disclosure, will appreciate that other embodiments can be devised which do not depart from the scope of the invention as disclosed here.

What is claimed is:

1. An apparatus for removing the floorplate of a firearm's magazine comprising:

a.) a substantially rectangularly shaped nylon ring with rounded corners having the dimensions of about 2.625 inches in length, about 1.500 inch in width and about 0.750 inches in height, where the ring receives a pistol magazine;

b.) a notch on the upper surface of the ring;

c.) a vertical slit located opposite the notch about 0.0625 to 0.2500 inches in width;

d.) two projections on the inner surface of the ring;

f.) two arms having a thickness of about 0.2750 inches.

2. An apparatus for removing a firearm magazine's floorplate comprising:

a. a substantially rectangularly shaped structure with rounded corners comprising an open end, a top surface, a bottom surface and an inner surface, where the structure receives a pistol magazine;

b. a notch located in the upper surface of the element;

c. a slit on the open end opposite the notch; and d. a plurality of projections located on the inner surface.

3. The apparatus of claim 2, where the slit is vertical.

4. The apparatus of claim 2, where the apparatus further comprises a polymer.

5. The apparatus of claim 4, where the polymer comprises glass filled nylon.

6. The apparatus of claim 2, where the plurality of projections on the inner surface comprises two projections.

7. The apparatus of claim 2, where the pistol magazine's floorplate locks with locking tabs in conjunction with a retaining pin.

8. An apparatus for removing a firearm magazine's floorplate comprising:

a. a substantially rectangularly shaped structure with rounded corners comprising an open end, a top surface, a bottom surface and an inner surface, where the structure receives a rifle magazine;

b. a notch located in the upper surface of the element;

c. a slit on the open end opposite the notch; and d. a plurality of projections located on the inner surface.

9. An apparatus for removing a floorplate of a firearm magazine comprising:

a. means for receiving the magazine;

b. a plurality of means for disassociating the locking tabs of a firearm magazine from the retaining cut-outs on the magazine's floorplate;

c. means for compressing the sides of the magazine;

d. means for limiting the amount of compression force applied to the side of the magazine; and e. a means for assisting in the removal of the floorplate.

* * * * *